United States Patent [19]

Wischusen, III

[11] Patent Number: 4,482,052

[45] Date of Patent: Nov. 13, 1984

[54] WEDGE-SHAPED STRIP DISPLAY CARTON

[75] Inventor: Henry Wischusen, III, Lilburn, Ga.

[73] Assignee: Rock-Tenn Company, Norcross, Ga.

[21] Appl. No.: 491,556

[22] Filed: May 4, 1983

[51] Int. Cl.[3] ..... B65D 85/67; B65D 85/671; B65D 75/58

[52] U.S. Cl. ..... 206/409; 206/45.31; 206/44.11; 229/22

[58] Field of Search ..... 206/409, 45.31, 44.11; 229/22

[56] References Cited

U.S. PATENT DOCUMENTS

| | | | |
|---|---|---|---|
| 1,833,974 | 12/1929 | Powell . | |
| 1,925,102 | 2/1933 | Levkoff | 206/44 |
| 3,006,527 | 10/1961 | Lofquist, Jr. | 229/22 |
| 3,134,525 | 5/1964 | Holcombe | 206/409 |
| 3,208,583 | 9/1964 | Kamps | 206/44 |
| 3,282,410 | 11/1966 | Cote | 206/45.31 |
| 3,471,006 | 10/1969 | Tempelhof | 229/22 |
| 3,659,707 | 5/1972 | Nilsson | 206/44.12 |
| 3,669,251 | 6/1972 | Phillips, Jr. | 206/44 R |
| 4,000,811 | 1/1977 | Hardison | 206/44 R |
| 4,027,795 | 6/1977 | Rigden | 206/409 |
| 4,113,100 | 9/1978 | Soja | 206/602 |

*Primary Examiner*—William T. Dixson, Jr.
*Attorney, Agent, or Firm*—Jones & Askew

[57] ABSTRACT

A wedge-shaped container is formed from a generally rectangular blank by collapsing triangular gusset panels defined in the side walls of the carton. The front wall panel includes a downwardly extending tongue that can be depressed into the carton to access a roll of strip material. An end of the strip material is drawn around the tongue and secured against the front wall panel of the carton for display to potential purchasers, and the entire carton and displayed strip material are preferably wrapped in clear plastic.

9 Claims, 3 Drawing Figures

WEDGE-SHAPED STRIP DISPLAY CARTON

TECHNICAL FIELD

The present invention relates to a carton formed from a flat blank of paperboard or the like, and more particularly relates to a wedge-shaped display carton used to display a product to potential purchasers of the product.

BACKGROUND ART

In marketing products, it is often essential to display the products in an inviting fashion to potential purchasers, such as in a retail store. In such instances, it is highly desirable that the product packaging, such as a paperboard carton, be suitable for displaying the product. Although plastic blister packs have been successfully used to display products without disrupting the packaging, most paperboard display cartons require that the carton be opened before the product inside can be displayed. Examples of such cartons are shown in U.S. Pat. Nos. 3,669,251; 3,208,583; 1,925,102; 4,113,100; 3,659,707; and 4,000,811.

It is also desirable in paperboard packaging to use as little paperboard as possible. If the product shape is appropriate, a wedge-shaped container requires multiple closure panels at only one end of the container. An example of a wedge-shaped container is shown in U.S. Pat. No. 1,833,974. However, the waxed paper milk carton shown therein in constructed from a blank having a highly irregular, and therefore inefficient, shape.

SUMMARY OF THE INVENTION

The present invention solves problems in the paperboard carton art by providing a wedge-shaped carton formed from a generally rectangular blank and by providing a paperboard carton capable of displaying on the exterior of the carton a strip of web-like material drawn from a supply of such material carried within the carton.

Generally described, the present invention provides a wedge-shaped carton of paperboard or the like formed from a generally rectangular blank, comprising front and back wall panels held in spaced apart relation by a pair of side wall panels foldably connected along score lines to the front and back wall panels; bottom panel means for enclosing one end of the carton; each of the side wall panels including first and second diagonal score lines defining fold lines extending from a common point along the score line connecting the side wall panel to the front wall panel, the first diagonal fold line extending to form a triangular gusset panel between the first diagonal fold line and the score line connecting the side wall panel to the front wall panel, and the second diagonal fold line dividing the triangular gusset panel; and means for retaining the carton in a wedge-shaped configuration such that the triangular gusset panels fold inwardly into the interior of the carton. An appropriately scored and cut flat paperboard blank for forming the carton also is a part of the present invention. The bottom panel means are preferably a set of conventional automatic bottom panels of the well known type which automatically form and lock in place when the carton is erected from a flat shipping configuration to a configuration ready for loading of the product. The means for retaining the carton in the wedge-shaped configuration is preferably a complete wrapping of the carton, such as with shrink-wrap plastic.

The display feature of the present invention is provided by including in the sloping panel of the wedge-shaped carton a tongue of carton material extending downwardly and being separated along three sides from the carton material. The tongue is depressable toward the interior of the carton to permit an end of a strip of material carried within the carton to be drawn out of the carton to lie along the slopping panel for display of the strip material. The end of the strip is secured to the panel by suitable means. When the carton is secured within a wrapping of clear plastic, the strip material can be easily seen by potential purchasers.

Thus, it is an object of the present invention to provide a wedge-shaped carton formed from a generally rectangular blank of paperboard or the like.

It is a further object of the present invention to provide an improved display carton for displaying a strip of web-like material drawn from inside the carton.

Other objects, features and advantages of the present invention will become apparent upon reviewing the following detailed description of a preferred embodiment of the invention, when taken in conjunction with the drawing and the appended claims.

DETAILED DESCRIPTION

Figure 1:
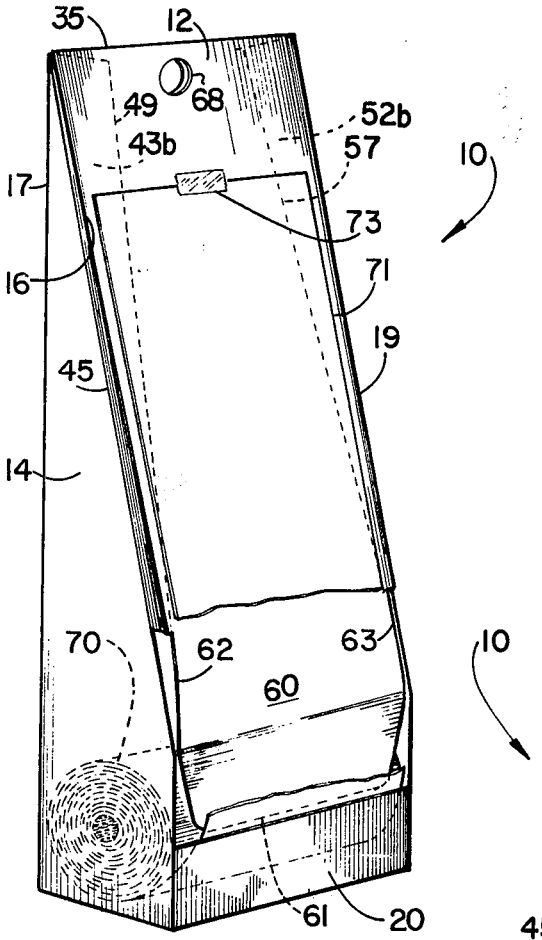
FIG. 1 is a pictorial view of a wedge-shaped carton embodying the present invention, showing in dashed lines a roll of strip material within the carton and an end of the strip material, partially broken away, extending from the interior of the carton to lie along the front panel of the carton.
Figure 3:
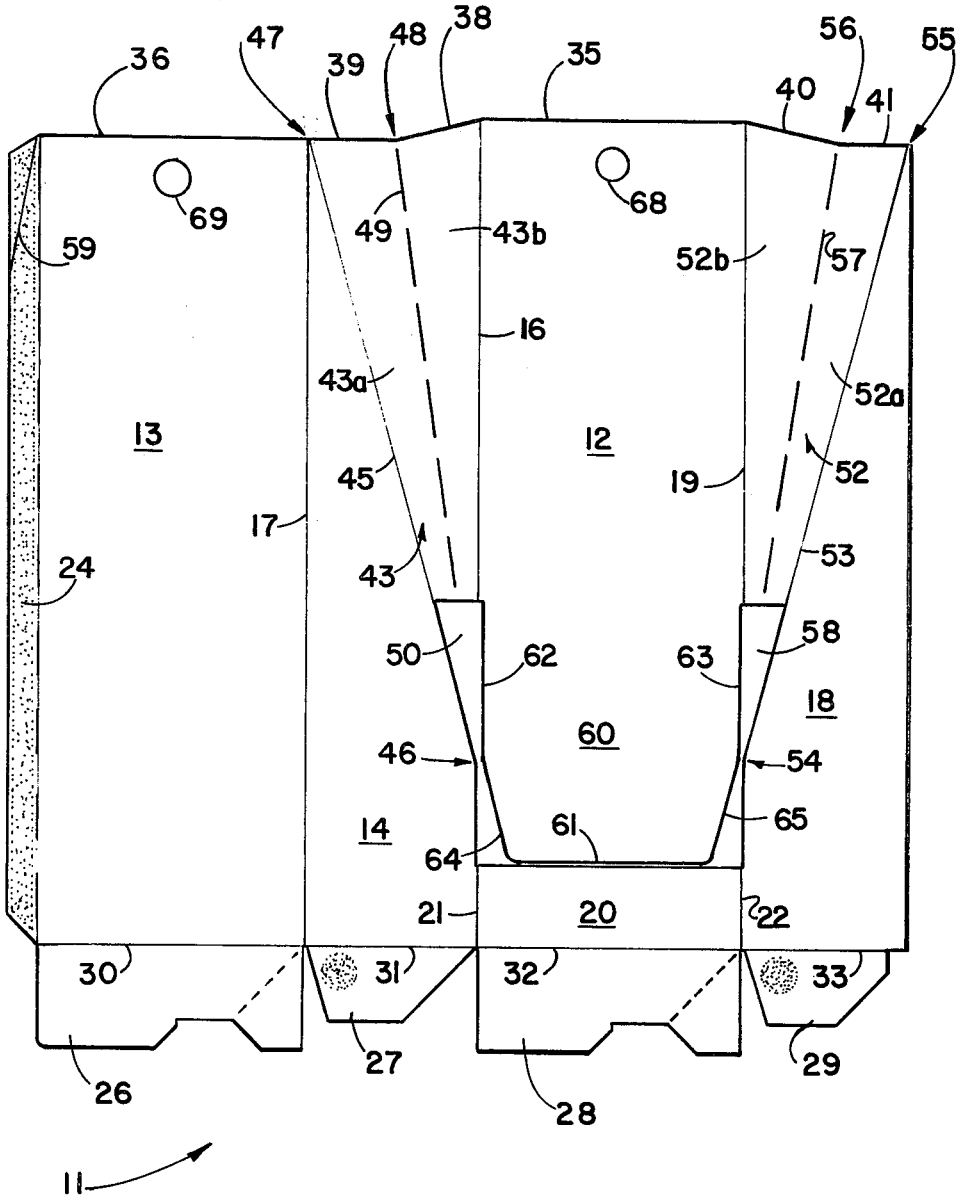
FIG. 3 is a plan view of a paperboard blank for forming a carton as shown in FIGS. 1 and 2.

Referring now in more detail to the drawing, in which like numerals refer to like parts throughout the several views, FIG. 1 shows a carton 10 embodying the present invention. A blank 11 for forming the carton 10 is shown in FIG. 3. The carton 10 includes a front wall panel 12 and a back wall panel 13 separated by a first side wall panel 14 and a second side wall panel 18. The first side wall panel 14 is connected to the front wall panel 12 along a score line 16, and to the back wall panel 13 along a score line 17. The second side wall panel 18 is connected to the front wall panel 12 along a score line 19. During assembly, described in more detail below, the second side wall panel 18 is foldably connected to the back wall panel 13 by means of a glue panel 24 extending outwardly along the length of the panel 13.

As shown, the side wall panels 14 and 18 are also connected by a bridging panel 20 connected to the side wall panel 14 along a score 21 and to the side wall panel 18 along a score 22. The bridging panel 20 connects the side wall panels adjacent to one end thereof below the front wall panel 12. A plurality of automatic bottom closure panels 26–29 are connected to the wall panels 13, 14, 20 and 18 along score lines 30–33, respectively. The automatic bottom panels are conventional in shape and function.

In FIG. 3, the front wall panel 12 includes a top free edge 35, and the back wall panel 13 includes a top free edge 36 which lies at a lower level than the edge 35. The side wall panels 14 and 18 each have a dual level top free edge consisting of segments 39 and 41, respectively which adjoin back wall panel 13 when the carton is assembled and are at the same level as the edge 36, and segments 38 and 40 which extend diagonally to connect the segments 39 and 41 to the edge 35 of the front wall panel 12.

The side wall panels 14 and 18 each include score lines defining gusset panels 43 and 52, respectively. The triangular gusset panel 43 is defined by a first diagonal score line 45 which defines a fold line extending from a point 46 along the score 16, which connects the front wall panel 12 to the side wall panel 14, to an upper corner 47 at the intersection of the score 17 with the free edges 36 and 39. To facilitate easy folding of the paperboard material along the scores 45 and 16, the paperboard is preferably continuously cut through the upper layers of the paperboard material. The triangular gusset panel 43 is divided into two triangular panels **43*a* and 43*b* by a second diagonal score 49 which defines a line of folding from the point 46 to a point 48 located where the free edges 38 and 39 meet. Score 49 bisects the gusset panel 43 and is preferably a jump cut score to facilitate folding. A triangular area of paperboard 50 is removed from the area of the gusset panel 43 adjacent to the point 46. This prevents bunching of the paperboard material that would occur at the point 46 if the portion 56** was not removed.

The gusset panel 52 is similarly defined in the side wall panel 18 by diagonal scores 53 and 57, which correspond to the scores 45 and 49. The score 52 extends from a point 54, corresponding to the point 46, to an upper corner 55 of the side wall panel 18. The score 57 extends to a point 56 located where the free edges 40 and 41 meet. A triangular area of paperboard is removed at 58 corresponding to the area 50. A diagonal score 59 is provided in the glue panel 24 so that when the glue panel 24 is adhered to the edge of the side wall panel 18, the scores 53 and 59 will align and the glue panel 24 will fold with the side wall panel 18 when the latter folds about the score 53.

The front wall panel 12 is cut at the lower end thereof to define a tongue of paperboard material 60 pointing toward the bridging panel 20. The tongue 60 has a lower edge 61 that is cut to separate the tongue from the bridging panel 20. The tongue 60 also defines a free edge 62 inset slightly from the line of the score line 16 and a free edge 63 inset from score line 19. The tongue 60 is provided with beveled lower corners 64 and 65 by removing paperboard material from the blank 11. Beveling of the corners at 64 and 65 allows the tongue 62 to be depressed slightly inwardly into the carton without the tongue 60 binding at the corners formed between the panel 20 and the side wall panels 14 and 18.

Mating openings 68 and 69 are provided in the front wall panel 12 and the back wall panel 13 for the purpose of ease in hanging the carton 10 when displaying the carton. A roll of web-like strip material 70 is shown in dashed lines in FIG. 1 loaded within the carton 10. The end 71 of the strip material, also shown in dashed lines, can extend past the end of the tongue 60 and can be laid against the outer surface of the front wall panel 12 in order to display the strip material. The end 71 of the strip is attached to the front wall panel 12 by suitable means such as adhesive tape 73. Alternately, liquid or paste adhesive could be used.

In order to assemble the carton 10 from the blank 11, the automatic bottom panels 26–29 are folded upwardly in a conventional manner. Glue is applied to the appropriate bottom panels and also to the glue panel 24. Then, the back wall 13 is folded about the score 17 to lie against the back of the side wall panel 14 and the front wall panel 12, and the side wall panel 18 is folded about the score 19 against the back of the front wall panel 12, with the edge of the side wall panel 18 becoming adhered to the glue panel 24. At the same time, the bottom panels adhere to one another in the conventional manner. The carton 10 is now assembled in a flattened form ready for shipping and for easy erection and loading.

Figure 2:
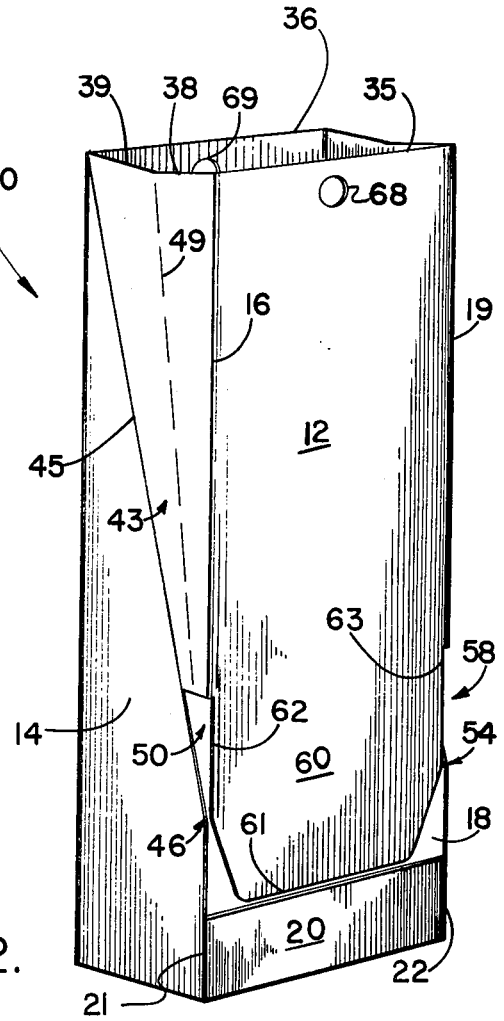
FIG. 2 is a pictorial view of a carton embodying the invention prior to folding in the gusset panels to cause the carton to assume a wedge-like shape.

When it is desired to utilize the carton 10, pressure is applied at the scores 17 and 19 to pop up the carton by separating the adjacent paperboard wall panels and causing them to assume a rectangular configuration as shown in FIG. 2. During erection, the automatic bottom panels automatically assume a locked configuration perpendicular to the wall panels, in a conventional manner. The briding panel 20 provides structural integrity and rigidity to the carton. It can now be loaded through its open top with, for example, a roll of strip material, such as a decorative wall paper trim strip. The roll 70 of such material is placed in the carton 10 with the finish surface of the strip facing outwardly and the end 71 of the roll unwinding from the bottom of the roll 70 toward the tongue 60 of the front wall panel 12. Either at this time or after the carton has been secured in a wedge configuration as shown in FIG. 1, the end 71 of the strip material is accessed by depressing the tongue 60. The end 71 of the strip material is drawn out of the carton over the end of the tongue 60, and is laid against the front panel 12 of the carton and secured with adhesive or with the tape 73. A potential purchaser can now precisely determine the nature of the product within the carton by viewing the portion of the product which lies along the outside of the carton.

To cause the carton 10 to assume the wedge-shaped configuration shown in FIG. 1, slight pressure is applied inwardly at the diagonal scores 49 and 57. This causes the gusset panels 43 and 52 to buckle or fold inwardly such that the front wall panel 12 can be moved into a plane defined in FIG. 2 by the scores 45 and 53. Since the free edge 35 of the front wall panel 12 is higher than the free edge 36 of the back wall panel 13 before the gusset panels are folded in (as shown in FIG. 2), upon collapsing the gusset panels, the edges 35 and 36 lie together, and the openings 68 and 69 align. Also aligning in the configuration shown in FIG. 1 are the scores 16 and 45, as well as 19 and 53. The cut out areas 50 and 58 avoid bunching of the paperboard material at the lower ends of the gusset panels, thereby permitting the front wall panel 12 to lie flat along the scores 45 and 53. Means for securing the front wall panel 12 in the position of FIG. 1 can be provided in the form of adhesive tape, glue, stapling, or a wrapping of the entire carton 10. The carton 10 is preferably shrink-wrapped in a clear plastic film (not shown) in order to protect the strip material from the roll 70 that is exposed on the exterior of the carton while still allowing the strip material to be viewed. It would also be possible to provide a glue flap extending upwardly from the free edge 36 of the back wall panel 13, or from the free edge 35 of the front wall panel 12, in order to retain the front and back wall panels adjacent to one another at their free edges.

It should be noted that the tongue portion 60 of the front wall panel 12 is biased outwardly by the natural stiffness of the paperboard material when the front wall panel 12 is folded into its sloped position as shown in FIG. 1. Therefore, the tongue 16 provides outward pressure on the strip material from the roll 70 and thereby places some tension on the strip material. This tension assists in maintaining the strip material in proper position for an attractive display. It should be noted also that the concepts of the present invention are not restricted to cartons of any particular height or width. The bottom panels can be of a type other than the automatic closure as shown and described in connection with the preferred embodiment. Although preferable, it is not necessary that the width of the tongue 60 be approximately the same as the width of the strip material being displayed.

While this invention has been described in detail with particular reference to a preferred embodiment thereof, it will be understood that variations and modifications can be made without departing from the spirit and scope of the invention as described hereinbefore and as defined in the following claims:

What is claimed is:

1. A wedge-shaped carton of paperboard or the like formed from a generally rectangular blank, comprising:

front and back wall panels held in spaced apart relation by a pair of side wall panels foldably connected along score lines to said front and back wall panels;

bottom panel means for enclosing one end of said carton;

each of said side wall panels including first and second diagonal score lines defining first and second diagonal fold lines extending from a common point along the score line connecting said side wall panel to said front wall panel, said first diagonal fold line extending upwardly to form a triangular gusset panel between said first diagonal fold line and said score line connecting said side wall panel to said front wall panel, and said second diagonal fold line dividing said triangular gusset panel;

said front wall panel including a bridging panel connecting said side wall panels to said bottom panel means, and a tongue panel extending downwardly to below said common point, said tongue panel being separated on three sides from the material of said carton below said common point; and means for retaining said carton in a wedge-shaped configuration such that said triangular gusset panels fold inwardly into the interior of said carton and said tongue panel projects outwardly beyond the plane of said bridging panel.

2. The carton of claim 1, further comprising means for securing a free end of said strip material to said front wall panel.

3. The carton of claim 1, wherein triangular areas of paperboard or the like are removed from said gusset panels adjacent to the point at which said diagonal fold lines meet said score lines connecting said side wall panels to said front wall panel.

4. The carton of claim 1, wherein said means for retaining said carton in a wedge-shaped configuration comprises a layer of wrapping material enclosing said carton.

5. The carton of claim 1, wherein said means for retaining said carton in wedge-shaped configuration comprises means for retaining an upper free edge of said front wall panel adjacent to a corresponding upper free edge of said back wall panel.

6. A generally rectangular blank of paperboard or the like for forming a collapsible wedge-shaped carton, comprising:

a front wall panel;

first and second side wall panels foldably connected along scores lines to opposite edges of said front wall panel;

a back wall panel foldably connected along a score line to said first side wall panel;

a glue panel extending from said back wall panel for connecting said back wall panel to said second side wall panel; and bottom forming panels foldably connected to said front, back and side wall panels;

said side wall panels each including a triangular gusset panel formed by a first diagonal score line defining a first diagonal fold line extending from a starting point along said score line connecting said side wall panel to said front wall panel, said gusset panel being divided by a second diagonal score line defining a second diagonal fold line extending from said starting point.

7. The blank of claim 6, wherein said front wall panel includes a bridging web connecting said side wall panels to one of said bottom forming panels; and a tongue separated on three sides thereof from said carton, said tongue terminating adjacent to said bridging web.

8. The blank of claim 6, wherein portions of said gusset panels adjacent to said starting point are removed.

9. In combination, a roll of strip material and a carton for carrying said roll; said carton including a panel comprising a first portion and a second portion, said first and second portions being separated and being disposed in angular relation to one another, and said first portion defining a torque of carton material, said tongue being separated along three sides thereof from said carton material and extending outwardly beyond the plane of said second portion and being depressable toward the interior of said carton to permit an end of said strip material to be drawn out of said carton to lie along said first portion of said panel for display of said strip material; and means for securing said strip material to said panel, said tongue placing tension on said strip material.

* * * * *